US006523908B2

(12) United States Patent
Forrest, Jr. et al.

(10) Patent No.: US 6,523,908 B2
(45) Date of Patent: Feb. 25, 2003

(54) WRAPPED FOAM SWAB

(75) Inventors: Edward J. Forrest, Jr., Marietta, GA (US); Kristine Y. Webb, Cumming, GA (US); K. Scott Kammerer, Atlanta, GA (US); James J. Holley, Alpharetta, GA (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 10/118,792

(22) Filed: Apr. 9, 2002

(65) Prior Publication Data

US 2002/0109397 A1 Aug. 15, 2002

Related U.S. Application Data

(62) Division of application No. 09/560,119, filed on Apr. 28, 2000, now Pat. No. 6,393,651.

(51) Int. Cl.[7] ..... A47L 13/10; A46D 3/00

(52) U.S. Cl. ..... 300/21; 15/209.1; 15/244.1

(58) Field of Search ..... 15/209.1, 210.1, 15/244.1; 300/21

(56) References Cited

U.S. PATENT DOCUMENTS 3,724,018 A * 4/1973 Sills
5,715,559 A * 2/1998 Mitri
5,855,214 A * 1/1999 Heneghan

* cited by examiner

*Primary Examiner*—Randall E. Chin
(74) *Attorney, Agent, or Firm*—Donald J. Breh; Mark W. Croll; Lisa M. Soltis

(57) ABSTRACT

A swab for cleaning electrical and particularly fiber optic connectors includes an elongated handle defining a longitudinal axis and having a cleaning head end and a grasping end. The swab includes a wrapped foam cleaning end. The wrapped foam cleaning end is formed from an elongated strip of microporous foam that is spiral wound about the cleaning end of the handle and is formed having a substantially flat cleaning end. A method for making the swab is also disclosed.

4 Claims, 1 Drawing Sheet

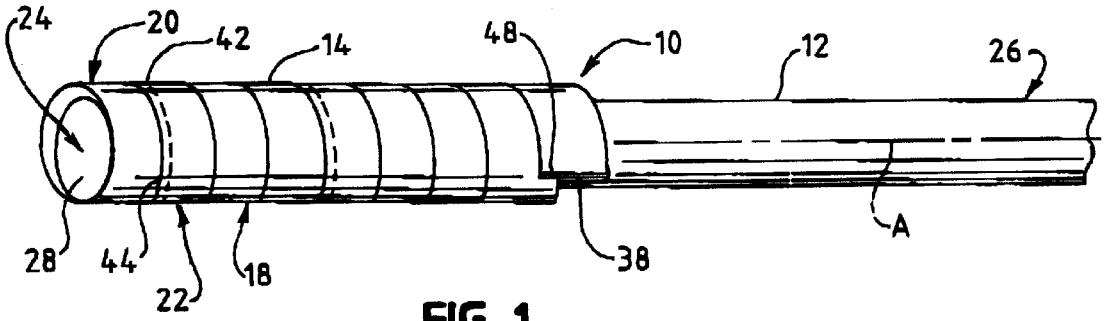
FIG. 1
FIG. 2
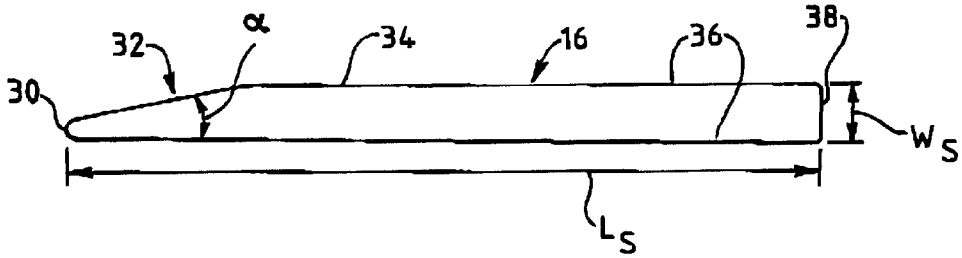
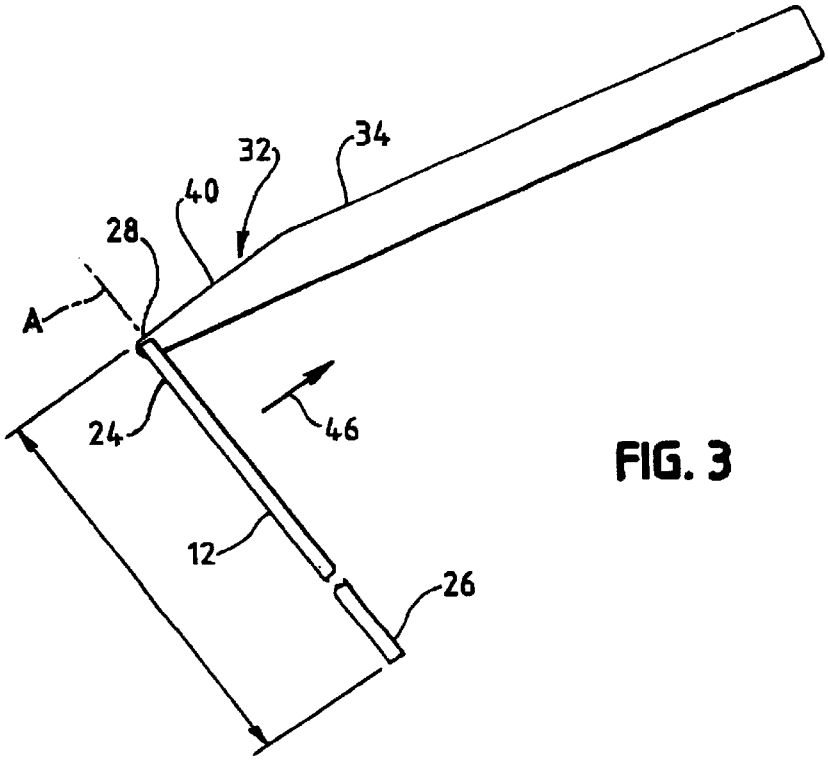
FIG. 3

WRAPPED FOAM SWAB

CROSS REFERENCE TO RELATED APPLICATION

This application is a divisional application of U.S. patent application Ser. No. 09/560,119, filed Apr. 28, 2000 now U.S. Pat. No. 6,393,651.

FIELD OF THE INVENTION

This invention pertains to a swab for cleaning. More particularly, the present invention pertains to a swab having a cleaning portion formed from spiral wrapped foam and a method for making swabs.

BACKGROUND OF THE INVENTION

Swabs are used in all manners of cleaning. For example, everyone will recognize common cotton tipped swabs that are used for person hygiene and care. Because of the compact and effective nature of these swabs, they have been adopted for use in numerous areas of technology and manufacture. One such area is the manufacture of electrical components and more specifically connectors for use in the telecommunications industry.

One particular type of connector used in the telecommunications industry is for use in fiber optic cables. In splicing or connecting fiber optic cable sections to one another, a connector is used. A typical connector includes a male portion and a female portion. During the manufacture of these cable sections, it is not unusual for pieces of manufacturing debris, such as pieces of fiber or fiber coating debris to be left within the ends of the connectors. It is also not unusual for light oils, such as fingerprint and other natural skin oils to be found on the parts in the ends of the connectors. As will be recognized by those skilled in the art, this debris and the oils can significantly degrade or prevent the transmission capabilities of the cables across the connectors.

Numerous types of cleaning implements have been used, with some degrees of success, to clean these particularly susceptible areas. It has, however, been observed that cleaning implements formed from non-particulate removing materials may not be acceptable for use in these connectors. Specifically, it has been found that particulates can become lodged in and around the connectors, thus adversely effecting the quality of the telecommunications signal.

In addition, it has been observed that these connectors can vary from one type to another For example, the connector female end can be formed as having a flat inner end surface, a concave surface or a convex surface. To this end, it has been found that regardless of the type of cleaning implement used, debris that settles into and around corners and oils that are present in these areas of the connector devices cannot be adequately removed.

Accordingly, there exists a need for a swab-type cleaning device that can be used for cleaning connectors. Desirably, such a device leaves little to no residue from the device within the connector. Most desirably, such a cleaning device removes particulate contaminants and light oils (e.g., fingerprint oils) and can be used to clean corner surfaces within the connector to remove essentially all manufacturing or other debris.

SUMMARY OF THE INVENTION

A swab for use in cleaning electrical connectors and in particular connectors for fiber optic cables includes an elongated handle defining a longitudinal axis and having a cleaning head end and a grasping end. A wrapped foam cleaning end is formed from an elongated strip of microporous foam The foam is spiral wound about the cleaning head end of the handle, and forms a substantially flat cleaning end.

In a preferred embodiment, the elongated strip of microporous foam is formed having a tapered end and the tapered end lies adjacent the cleaning head end of the handle. Preferably, the taper is formed at an angle of about 10 degrees to about 15 degrees and most preferably about 12 degrees. Most preferably, the tapered end terminates in a rounded tip portion that is affixed to the cleaning head end. In this manner, the tapered end defines a tapered edge that is positioned so as to wrap around the handle at the cleaning head end.

In the preferred embodiment, a free end of the microporous foam is secured, at least in part, onto itself, distal from the clean head end. At the cleaning head end, the tip is secured to the handle by heating the handle to softening and contacting the foam to the handle. The foam is secured to itself at the free end by searing.

A method of forming the swab includes the steps of providing an elongated handle having a longitudinal axis, providing a strip of microporous foam and forming a tapered edge along an elongated dimension of the strip of foam. The method further includes securing a tip of the foam at the tapered edge to an end of the elongated handle, spiral winding the foam about the handle so as to overlap a lower edge of a first wrap with an upper edge of a subsequent wrap and securing a trailing end of the foam onto itself.

The method can further include forming a rounded tip at an end of the strip at the tapered edge. The step of securing the tip of the foam to the handle can include heating the handle and contacting the foam to the handle. The step of securing the trailing end of the foam can include searing the foam onto itself.

Other features and advantages of the present invention will be apparent from the following detailed description, in conjunction with the appended claims.

BRIEF DESCRIPTION OF THE FIGURES

FIG. 1 is an illustration of the cleaning end of a wrapped foam swab embodying the principles of the present invention;

FIG. 2. is an illustration of a foam strip that has been configured for wrapping onto a handle; and FIG. 3 is an illusion of the foam strip of FIG. 2 further showing a handle placed onto the strip for positioning for carrying out the method of making the swab.

DETAILED DESCRIPTION OF THE PREFERRED EMBODIMENTS

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

Referring to the figures and in particular to FIG. 1 there is shown a wrapped foam swab 10 in accordance with the principles of the present invention. The swab includes a handle 12 and a foam cleaning head 14. The foam cleaning head 14 is formed from a foam strip 16 as best seen in FIG. 2.

The foam strip 16 is wrapped around the handle in a spiraled manner, as indicated at 18. The foam strip 16 is wrapped around the handle so that a firs wrap 20 is overlapped, in part, by a second or subsequent wrap 22. Thus, the foam strip is self-securing on the handle once it has begun to be wrapped In a present embodiment, the handle 12 is formed from a polymeric material, such as polypropylene or the like. The handle 12 is essentially a cylindrical polypropylene stick. In a current embodiment, the handle has first and second or cleaning and grasping ends 24,267 respectively.

The cleaning end 24 of the handle 12 is formed having a flat head 28. Tat is, the head 28 is formed by cutting transversely across a longitudinal axis A of the handle. The grasping end of the handle 26 is not required to have such a flat head, however, for ease of manufacturing it may be formed as such so that both the cleaning end 24 and the grasping end 26 of the handle are essentially identical to one another. In a present embodiment, the handle 12 is a polypropylene stick having a diameter of about 5 millimeters, a length of about 150 millimeters, and having a flat cut head at the cleaning end 24.

Referring now to FIG. 2, the foam strip 16 has a rounded tip 30 contiguous with a tapered head or wrap area 32. The tapered head area 32 terminates at the main body of the strip 34. The main body 34 has parallel sides 36 that terminate at a securing end 38 of the strip 16. In a present embodiment, the strip 16 has a length $L_s$ from the tip 30 to the end 38 of about 757 millimeters and a width $W_s$ at the securing end 38 of about 5.6 millimeters The tapered area 32 extends from the rounded tip 30 about 22 millimeters along the longitudinal length $L_s$ of the strip 16. To this end, the tapered region is formed at an angle a of about 10 degrees to about 15 degrees, and preferably about 12 degrees relative to the longitudinal length $L_s$.

In a current embodiment, the foam strip is formed from a microporous foam Preferably, the foam is a polyurethane material and the strip 16 is cut from a sheet of this material. An exemplary polyurethane, microporous foam is commercially available under the trade name Rubycell Sheet Wipers from the Toyo Eizai Corporation, of Osaka, Japan as Item No. RC-810. In the current embodiment of the wrapped foam swab 10, the foam sheet has a thickness of about 0.8 millimeters.

A method of making the swab includes cutting the foam sheet into strips having a width $W_s$ of about 5.6 millimeters and a length $L_s$ of about 75.7 millimeters. A rounded tip 30 is then formed, as is the tapered wrap area 32.

A handle 16 is positioned on the strip 16 with the longitudinal axis A substantially perpendicular to the tapered wrap area 32 edge 40. In a preferred method, the rounded tip 30 is secured to the flat end portion 28 of the handle 16, such as by heating the handle 16 until softening and then contacting the softened region with the strip 16.

The strip 16 is then wound onto the handle 12 beginning with a substantially flat roll at the end portion 28, and by rolling the handle 16 or winding the tapered head region edge 40 perpendicular handle axis A, as indicated by the arrow at 46. The wrap is continued in a spiraled manner so that the wrapping moves downwardly along the length of the handle 16 away from the cleaning end 24. Spiraling is accomplished by overlapping a lower end 42 of a first wrap 20 with an upper end 44 of a next subsequent wrap 22.

Wrapping is continued until the strip end 38 lies adjacent the handle. The strip 16 is then secured onto itself. In a preferred method, the strip is seared, such as by heating, to secure it onto itself such as indicated at 48.

As will be recognized from the figures and the above description, the cleaning end 14 of the present swab 10 is configured having a substantially flat head portion. In that many of the electrical connectors, and in particular, fiber optic connectors have flat, convex or concave interior surfaces or regions, it has been observed that the present swab 10 functions surprisingly well in cleaning corners and/or convex or concave regions of particulate and light oil contaminants that may be present in the connectors.

Samples of swabs prepared in accordance with the principles of the present invention were compared to commercially available fabric swabs to determine the quantity and size range of particles released from the swabs, prior to use, in a simulated environment. No significant difference was found in the particulate levels between the wrapped foam swab and the commercially available fabric swab. Both swabs were also found to have no detectable level of non-volatile residue.

In conducting his comparison, twenty of each the wrapped foam and fabric swabs were deposited in respective containers of water. The water was then collected and liquid particle counts were conducted. From the results of this comparison, it was observed that, statistically, the differences in particles released between the wrapped foam swab and the known fabric swab were insignificant. However, as provided elsewhere herein, the present wrapped foam swab has other characteristics (e.g., fit into connectors and oil removal properties) that were found to be superior to the known fabric swabs.

From the foregoing it will be observed that numerous modifications and variations can be effectuated without departing from the true spirit and scope of the novel concepts of the present invention. It is to be understood that no limitation with respect to the specific embodiments illustrated is intended or should be inferred The disclosure is intended to cover by the appended claims all such modifications as fall within the scope of the claims.

What is claimed is:

1. A method of forming a swab comprising the steps of:

providing an elongated handle having a longitudinal axis;

providing a strip of microporous foam;

forming a tapered edge along an elongated dimension of the strip of foam;

securing a tip of the foam at the tapered edge to an end of the elongated handle;

spiral winding the foam about the handle so as to overlap a lower edge of a first wrap with an upper edge of a subsequent wrap; and securing a trailing end of the foam onto itself.

2. The method of forming a swab in accordance with claim 1 including the step of forming a rounded tip at an end of the strip at the tapered edge.

3. The method of forming a swab in accordance with claim 1 wherein the step of securing a tip of the foam to the handle includes the steps of heating the handle and contacting the foam to the handle.

4. The method of forming a swab in accordance with claim 1 wherein the step of securing a trailing end of the foam includes searing the foam onto itself.

* * * * *